US008227676B2

(12) United States Patent
Jackson et al.

(10) Patent No.: US 8,227,676 B2
(45) Date of Patent: Jul. 24, 2012

(54) TROMBONE HAND GRIP DEVICE

(75) Inventors: Terry R. Jackson, Bozeman, MT (US); Stephen P. Culliton, Belgrade, MT (US)

(73) Assignee: OP/Tech Usa, Inc., Belgrade, MT (US)

( * ) Notice: Subject to any disclaimer, the term of this patent is extended or adjusted under 35 U.S.C. 154(b) by 63 days.

(21) Appl. No.: 12/830,769

(22) Filed: Jul. 6, 2010

(65) Prior Publication Data

US 2012/0006177 A1 Jan. 12, 2012

(51) Int. Cl.
*G10D 7/08* (2006.01)

(52) U.S. Cl. ..... 84/385 A; 84/380 R

(58) Field of Classification Search ..... None
See application file for complete search history.

(56) References Cited

U.S. PATENT DOCUMENTS

| | | | | |
|---|---|---|---|---|
| 3,141,369 | A | 7/1964 | Miccio | |
| 3,847,051 | A | 11/1974 | Miller | |
| 4,265,212 | A * | 5/1981 | Wolf | 124/20.1 |
| 5,894,098 | A | 4/1999 | Hsieh | |
| 6,118,059 | A | 9/2000 | Ternes | |
| 6,759,584 | B2 | 7/2004 | Sundstrom | |
| 7,396,985 | B1 | 7/2008 | Roth | |
| 7,638,699 | B2 * | 12/2009 | Buettgen | 84/387 A |

FOREIGN PATENT DOCUMENTS

| | | | |
|---|---|---|---|
| DE | 3642134 | A1 | 6/1988 |
| DE | 19505745 | A1 | 8/1996 |

* cited by examiner

*Primary Examiner* — Kimberly Lockett
(74) *Attorney, Agent, or Firm* — Holland & Hart LLP

(57) ABSTRACT

A trombone hand grip device comprising a bushing securable about the intersection of a trombone's first brace and slide tube with a hand grip removably attachable to the bushing. The bushing being comprised of two shells hingedly connected to each other. The hand grip includes a clamp that is adapted for removable attachment to the bushing and a hand receiver fastened to the clamp. The hand grip includes a flexible strap attached to the hand receiver for wrapping around a player's hand. The hand receiver includes a plurality of mounting holes through which the hand receiver is mounted to the clamp. The position of the hand grip is adjustable longitudinally along the direction of the trombone slide by selecting one of the mounting holes. The hand receiver includes radial arrays of rotational adjustment holes associated with each of the mounting holes, whereby the grip may be rotationally adjusted.

19 Claims, 16 Drawing Sheets

TROMBONE HAND GRIP DEVICE

BACKGROUND

The trombone is a musical instrument in the brass family. The trombone is usually characterized by a telescopic slide which a player moves in order to vary the length of the tube thereby changing pitches. A typical trombone weighs between 11 and 17 pounds depending on the type. The weight of the instrument is usually supported with one hand while the player's other hand is free to adjust the position of the slide. Supporting the weight of the trombone with one hand during long performances can result in strain and discomfort in the player's hand. Players with smaller hands are particularly prone to hand strain when playing the trombone because their hands cannot reach across the top and bottom slide tubes in the traditional manner. Thus, players with smaller hands must compensate with alternate and often less than ideal hand hold positions.

Accordingly there is a need for a trombone hand grip device that aids in supporting a trombone in the proper playing position. It is desirable to have such a device that is configurable to fit different styles of trombones and adjustable for playing comfort and performance. Furthermore, it is desirable that the hand grip device be easily installed and removed in order to allow the trombone to be stored in a standard trombone case.

SUMMARY

Described herein are various embodiments of a trombone hand grip device. The trombone hand grip device supports the weight of a trombone while maintaining the proper playing position. Generally, the hand grip device comprises a bushing that attaches to the trombone to create a platform for the hand grip to snap onto. Once the bushing is firmly attached to the trombone, the hand grip is snapped into place. While the custom-fit bushing remains on the instrument, the hand grip portion is easily removed for storing and transporting the instrument.

The hand grip is attached to the clamp with hardware such as a screw. The hand grip can be attached to the clamp forward and backward (longitudinally) relative to the trombone slide by moving the attaching screw to one of a plurality of mounting holes. The hand grip can also be rotated. The rotational adjustment is effected by inserting a protrusion or pin extending from the grip clamp, into one of a plurality of smaller holes located radially about each mounting hole.

The grip incorporates a soft, durable neoprene strap which closes securely and comfortably across the back of the hand. It allows for a full range of movement and a comfortable, yet secure hold on the instrument.

In an exemplary embodiment, the trombone hand grip device comprises a bushing securable about the intersection of a trombone's first brace and slide tube, and a hand grip removably attachable to the bushing. The bushing is, preferably, comprised of two shells hingedly connected to each other in a clam shell configuration. The hand grip includes a clamp that is adapted for removable attachment to the bushing and a hand receiver fastened to the clamp. The hand grip includes a flexible strap attached to the hand receiver for wrapping around a player's hand.

The hand receiver includes a plurality of mounting holes through which the hand receiver is mounted to the clamp. The position of the hand grip may be adjusted longitudinally along the direction of the trombone slide by selecting one of the mounting holes. The hand receiver may also include radial arrays of rotational adjustment holes associated with each of the mounting holes. The clamp includes a protrusion sized and configured to engage the rotational adjustment holes, whereby the hand grip may be rotationally adjusted as desired.

Preferably the clamp is configured to snap onto the bushing. The bushing and the clamp include a cooperative slot and tab arrangement. For instance, the bushing may include a tab and the clamp a mating slot, whereby the clamp pivots about the tab in order to snap onto the bushing.

Also contemplated, is a trombone hand grip kit for mounting the hand grip device to various types of trombones having different brace configurations. The kit comprises a plurality of bushings securable about the intersection of a trombone's first brace and slide tube and a hand grip removably attachable to the bushings. Each of the plurality of bushings is configured for a different first brace configuration. The kit, preferably, includes a plurality of bushing shims for use with trombones having different sized slide tubes. The kit's hand grip components may be pre-assembled for the consumer's convenience.

The foregoing and other features, utilities, and advantages of the trombone hand grip device will be apparent from the following more particular description of the embodiments as illustrated in the accompanying drawings.

BRIEF DESCRIPTION OF THE DRAWINGS

The accompanying drawings, which are incorporated in and constitute a part of this specification, illustrate embodiments of a trombone hand grip device and together with the description, serve to explain the principles and operation thereof. Like items in the drawings are generally referred to using the same numerical reference.

DETAILED DESCRIPTION

Described herein is a trombone hand grip device that aids a player in comfortably supporting a trombone in the proper playing position. The disclosed hand grip device is configurable to fit different styles of trombones and adjustable for playing comfort and performance. The hand grip device is easily installed and removed in order to allow the trombone to be stored in a standard trombone case.

Figure 1:
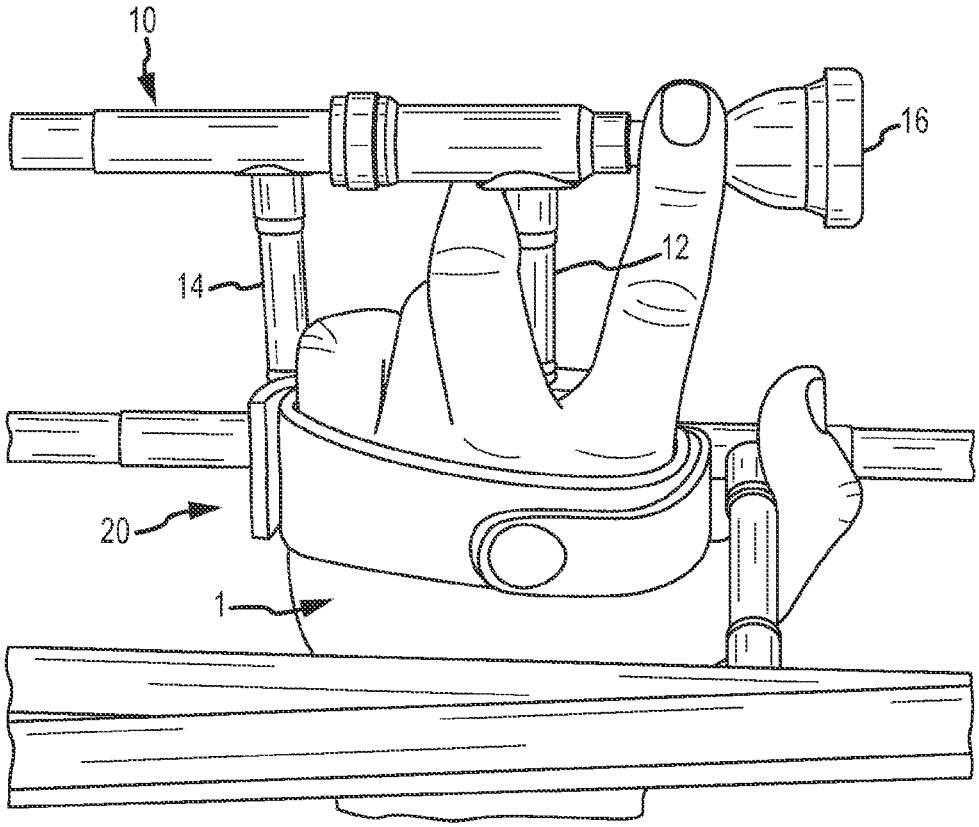
FIG. 1 is a partial perspective view of a trombone fitted with an embodiment of the trombone hand grip device as viewed from the back of the hand.
Figure 2:
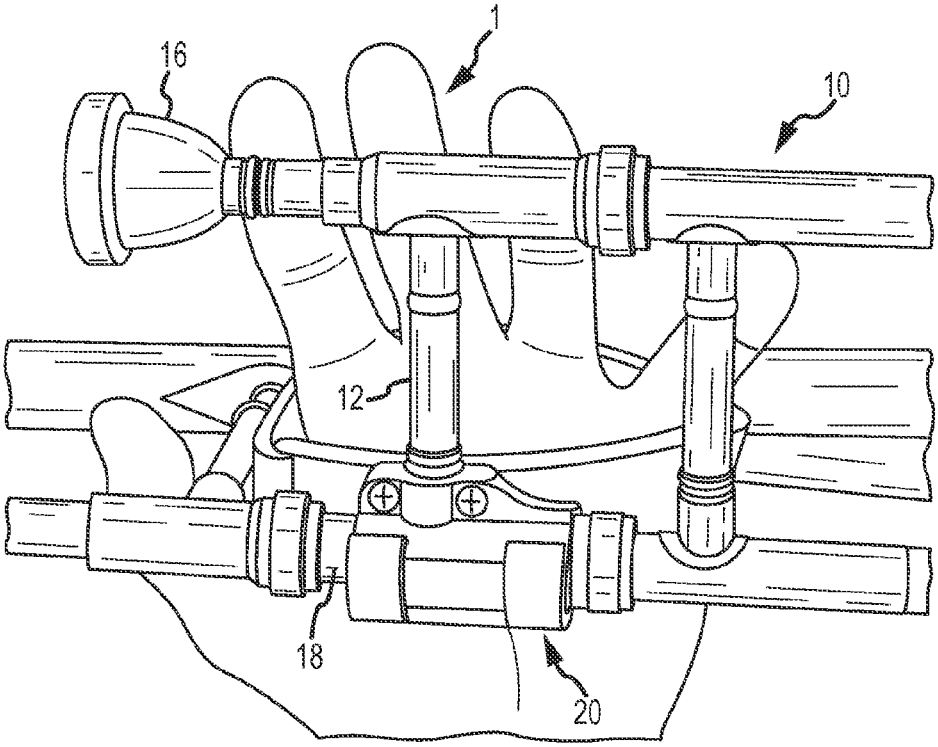
FIG. 2 is a partial perspective view of the hand grip device shown in FIG. 1 as viewed from the palm of the hand.

As shown in FIGS. 1 and 2, the typical trombone 10 includes slide tube 18 and first and second slide braces 12 and 14, respectively. Trombone 10, shown in FIG. 1, has been fitted with hand grip device 20 which is adapted to receive a player's hand 1. As perhaps best shown in FIG. 2, it can be appreciated that the hand grip device 20 is attached to trombone 10 at a location proximate the intersection of slide tube 18 and first brace 12. It should also be noted that the hand grip device 20 is attached to the trombone slide opposite mouth piece 16.

Figure 3:
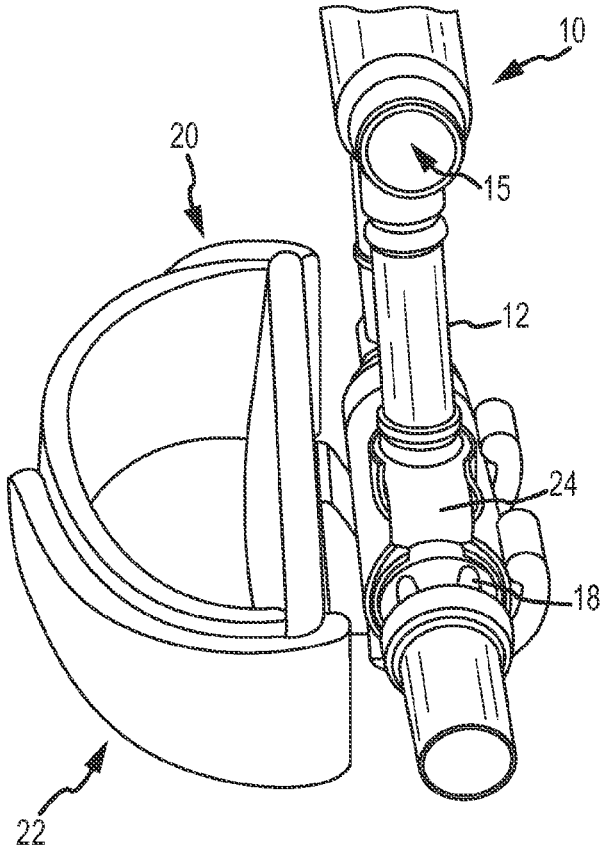
FIG. 3 is a partial perspective view of the hand grip device shown in FIGS. 1 and 2 as viewed from along the trombone slide tube.

As shown in FIG. 3, hand grip device 20 includes bushing 24 and hand grip 22. Hand grip 22 is removably attachable to bushing 24. Conveniently, bushing 24 may be securely mounted to slide tube 18 and left in place on the trombone permanently. Hand grip 22, however, may be removed and attached as desired. For example, handgrip 22 may be removed for storage of the trombone and attached to bushing 24 when the trombone is in use.

Figure 4:
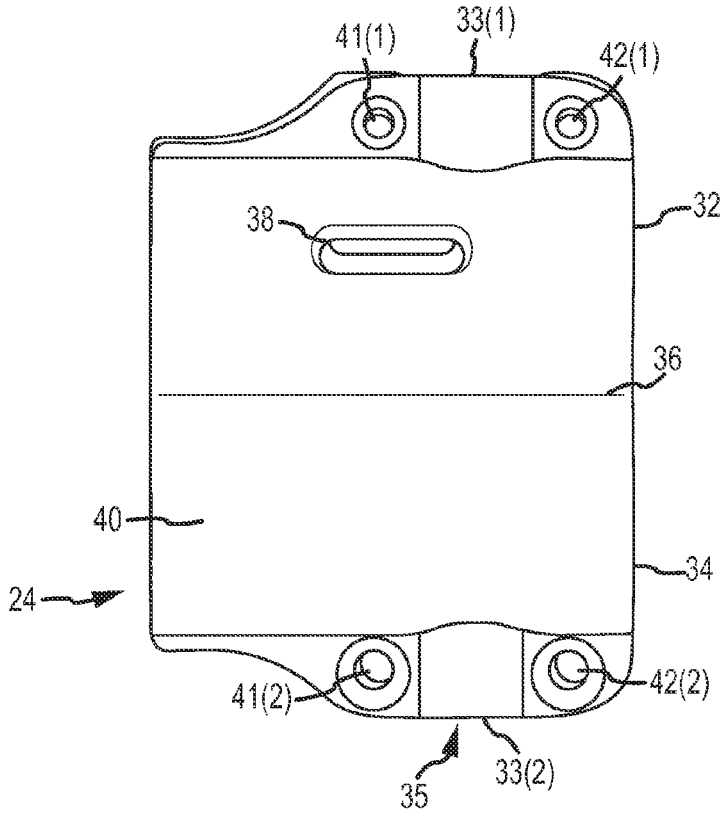
FIG. 4 is a top plan view of a hand grip device bushing.
Figure 5:
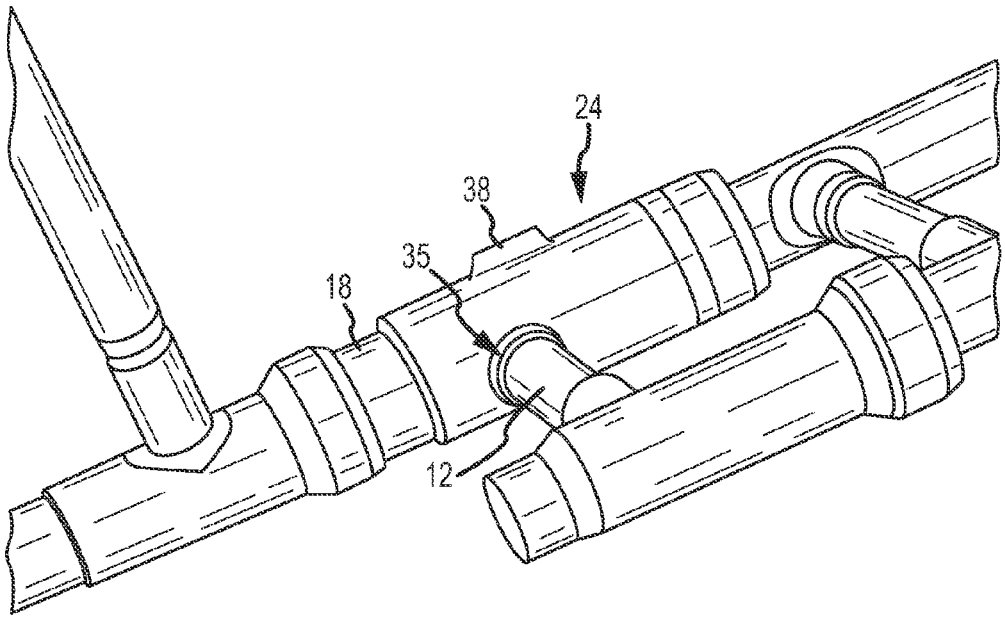
FIG. 5 is a partial perspective view showing the hand grip device bushing installed on the intersection of the trombone slide tube and first brace.

FIG. 4 is an enlarged view showing the construction of bushing 24 shown in FIG. 3. Bushing 24 includes a pair of shells 32 and 34, which are pivotably connected to each other by hinge 36. Thus, bushing 24 has a clamshell configuration which may be closed around slide tube 18 of trombone 10. When shells 32 and 34 are closed they form in interior 40 through which slide tube 18 extends. Bushing 24 also includes brace reliefs 33(1) and 33(2) which provide clearance for first brace 12. Here again, when bushing halves 32 and 34 are closed, reliefs 33(1) and 33(2) form at opening 35 that intersects with interior 40 and through which first brace 12 extends. With further reference to FIG. 5, the installation of bushing 24 on trombone 10 may be better appreciated. Once the bushing is closed around the intersection of the slide tube and brace fasteners may be used to secure the bushing the closed configuration. Fastener holes 41(1), 41(2), 42(1), and 42(2) are provided on both sides of the brace reliefs 33(1) and 33(2). As shown in FIGS. 4 and 5, bushing 24 also includes a tab 38 for facilitating the attachment of handgrip 22 to bushing 24 as described more fully below. Bushing 24 may be comprised of molded plastic or other suitable material. Plastic constructions allows for hinge 36 to be an integrally formed living hinge as is known in the art. Other materials such as metal, including aluminum, brass, or steel, may also be used to form the bushing. As such hinge 36 may be a conventional hinge. Furthermore, while the various bushing embodiments disclosed herein are illustrated with respect to a hinged construction, the bushing halves may be attached by fasteners, snaps, hinges, and the like, or combinations thereof.

Figure 6:
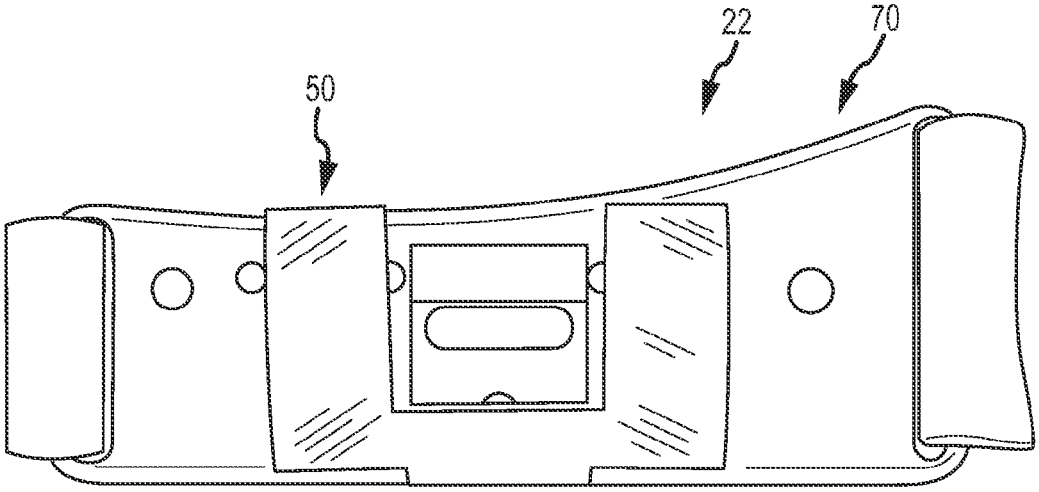
FIG. 6 is a side view in elevation of the hand grip shown in FIGS. 1-3.
Figure 7:
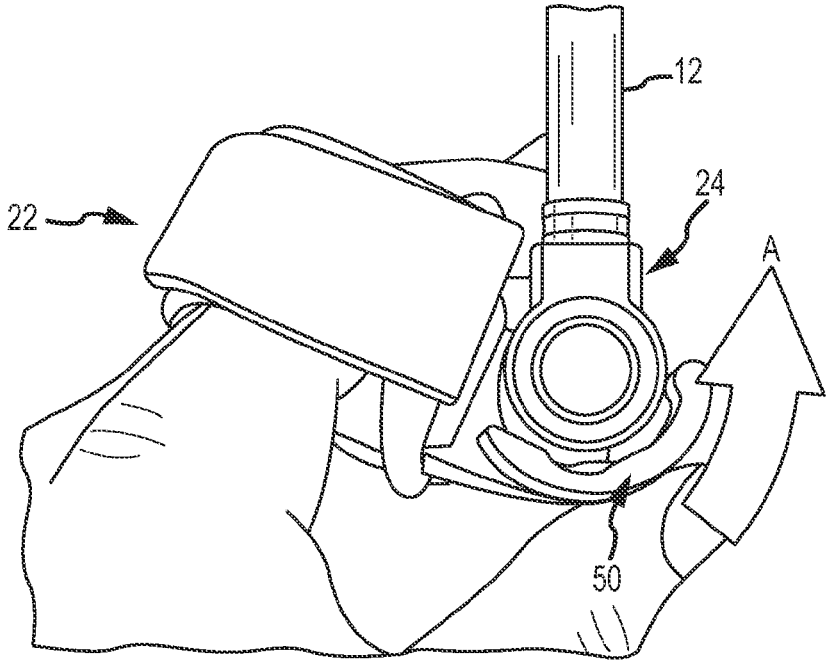
FIG. 7 is a partial perspective view of the hand grip device as viewed from the slide tube showing the attachment of the hand grip onto the bushing.
Figure 8:
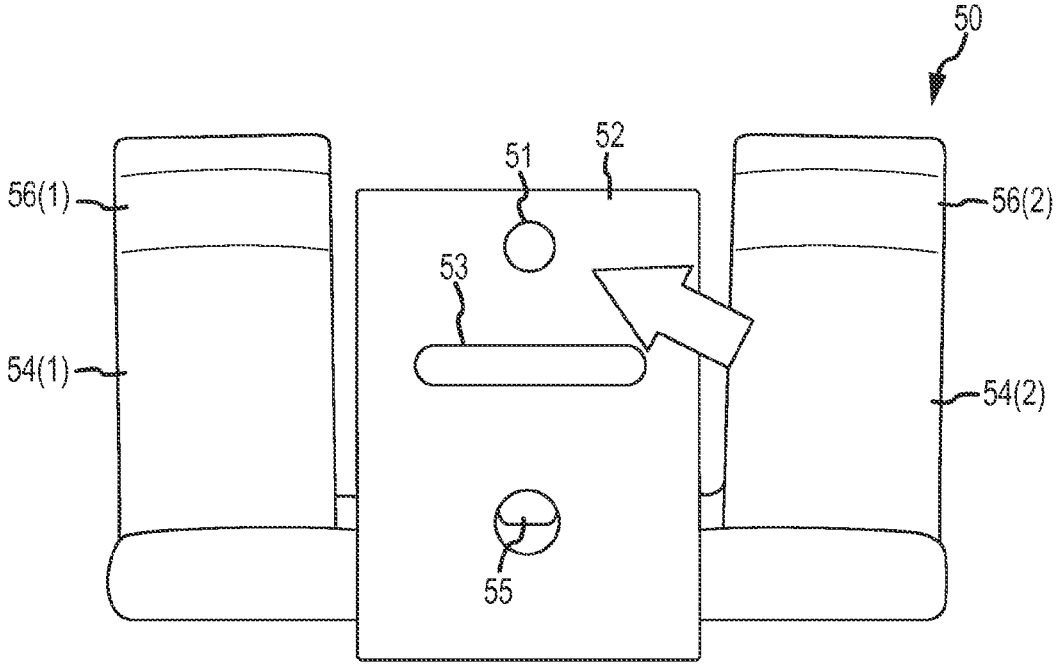
FIG. 8 is a front view in elevation of a grip clamp.

FIG. 6 illustrates that handgrip 22 includes a grip clamp 50 with a strap assembly 70 attached thereto. As shown in FIG. 7, clamp 50 snaps onto bushing 24 in the direction of arrow A. With further reference to FIG. 8, clamp 50 includes slot 53, which is configured to engage tab 38 of bushing 24 (see FIG. 5). It can therefore be appreciated that slot 53 is engaged with 38 at which point clamp 50 may be pivoted about tab 38 such that clamp 50 snaps onto bushing 24.

Figure 9:
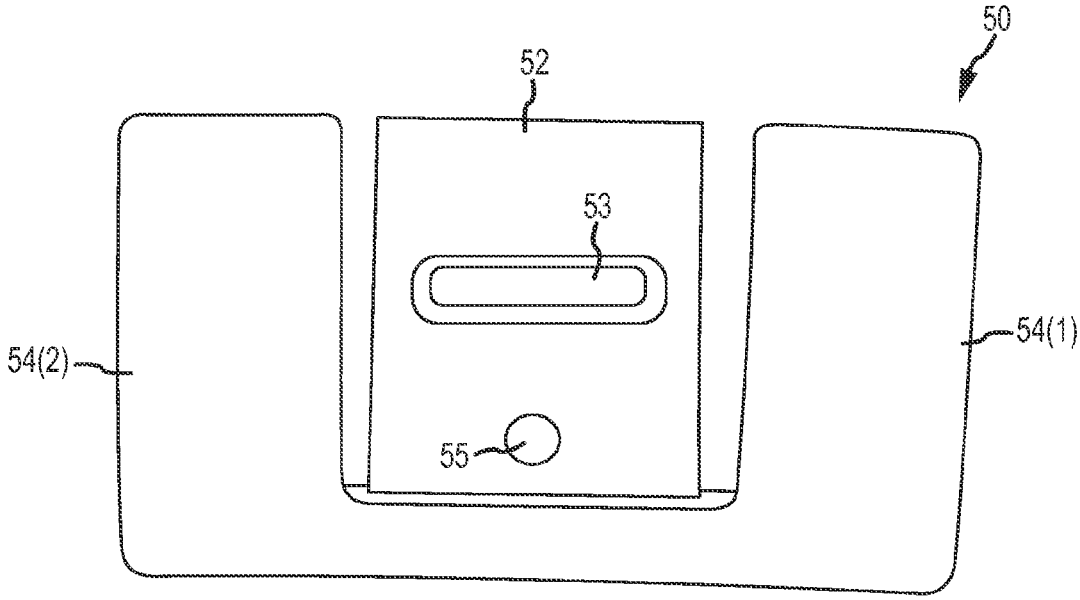
FIG. 9 is a back view in elevation of the grip clamp shown in FIG. 8.

With continued reference to FIGS. 8 and 9, it can be appreciated that clamp 50 includes base portion 52 and clamp arms 54(1) and 54(2) extending therefrom as shown. It should also be noted that each arm and 54(1) and 54(2) includes a respective ridge 56(1) and 56(2) for snapping clamp 50 to bushing 24. Base portion 52 also includes receiver mounting hole 55 and protrusion 51. Mounting hole 55 and protrusion 51 are used in attaching strap assembly 70 to clamp 50 as described more fully below. As with the bushing 24, clamp 50 may be comprised of molded or machined plastic material. However, clamp 50 may be formed from other suitable materials such as described above with respect to bushing 24.

Figure 10:
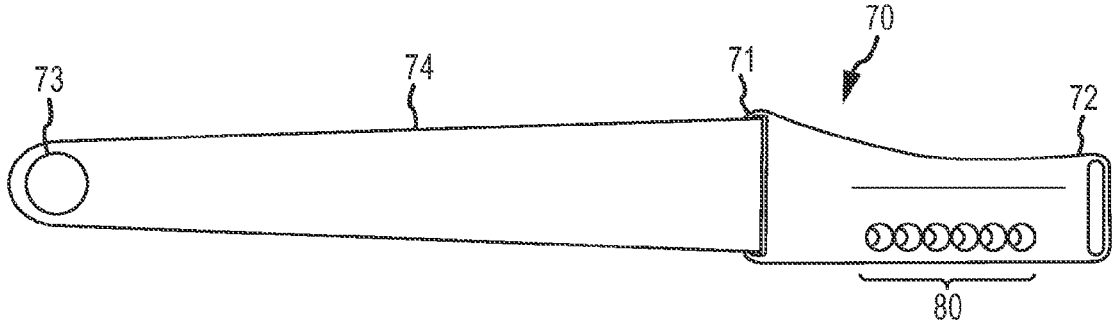
FIG. 10 is a top plan view of a hand receiver.

Referring now to FIG. 10, strap assembly 70 includes hand receiver 72 and strap 74. Strap 74 is attached to hand receiver 72 at a first end portion 71. First end portion 71 extends through slot 75 formed through hand receiver 72. First end portion 71 may be folded over on itself and stitched 76 in place as shown. Second end portion 73 is received through slot 77 and is folded back on itself in an adjustable manner. Strap 74 may be secured in place around a player's hand with cooperative hook and loop fastener materials as are known in the art, for example. The strap may be formed from a suitable flexible strap material as known in the art, such as neoprene, nylon, leather, elastic, or the like.

Figure 11:
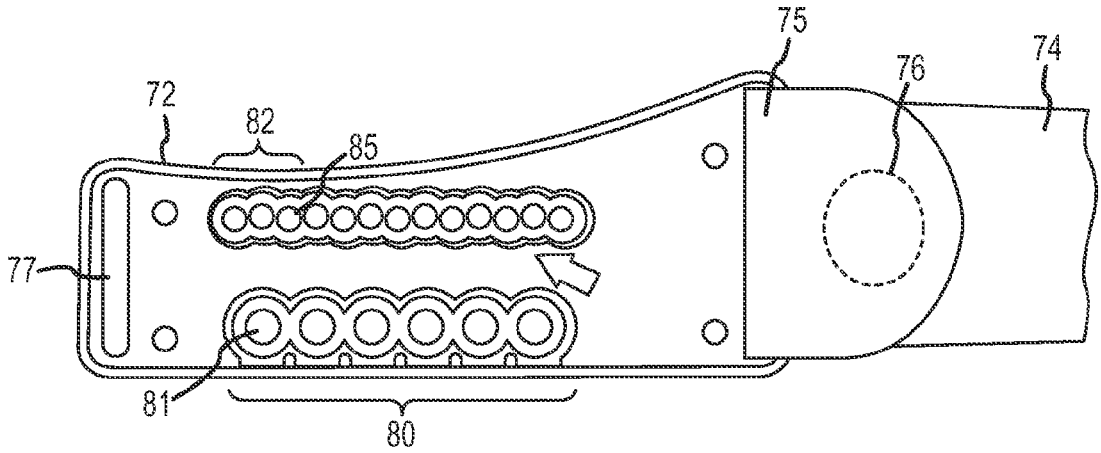
FIG. 11 is an enlarged partial bottom plan view of the hand receiver shown in FIG. 10.
Figure 12:
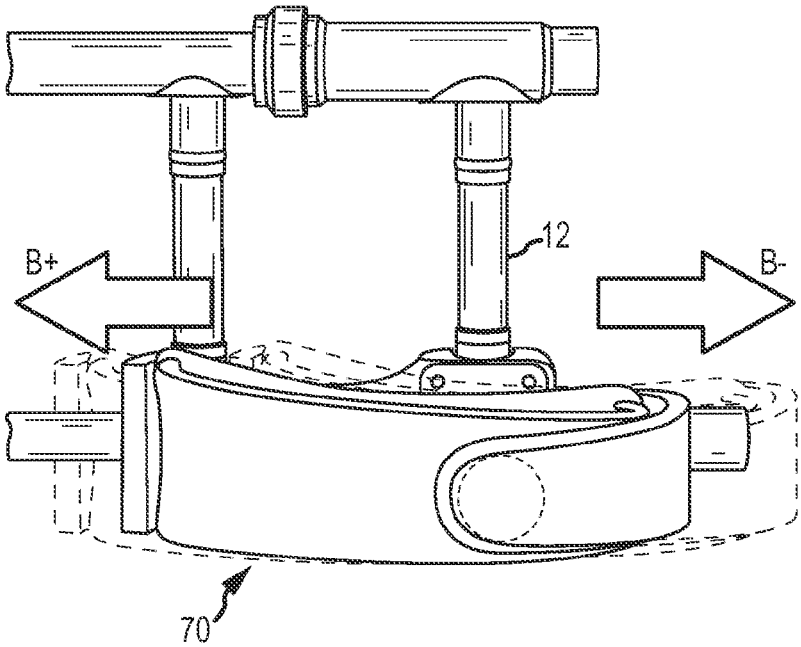
FIG. 12 is a partial perspective view of the trombone hand grip device illustrating the longitudinal adjustability of the hand grip.

Hand receiver 72 includes a plurality of mounting holes 80 as shown in FIG. 11. Thus, hand receiver 72 is mounted to base portion 52 of clamp 50 through mounting hole 55 and one of mounting holes 80. Hand receiver 72 may be fastened to clamp 50 with any suitable fastener as know in the art, such as with screws and related hardware. With further reference to FIG. 12 it can be appreciated that strap assembly 70 may be adjusted longitudinally (arrows B+ and B−) along the trombone's slide by selecting different mounting holes 80.

Figure 13:
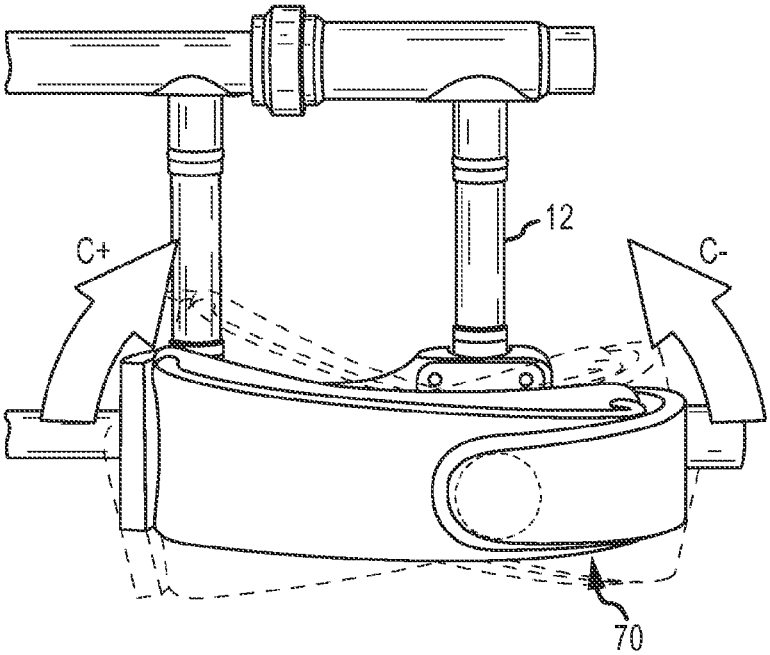
FIG. 13 is a perspective view of the trombone hand grip device illustrating the rotational adjustability of the hand grip.

Also show in FIG. 11, each mounting hole 80 has an associated radial array of rotational adjustment holes 85. For example, mounting hole 81 has an associated radial array 82. In this case, radial array 82 comprises three holes. Protrusion 51, as mentioned above with respect to FIG. 8, cooperates with rotational adjustment holes 85 to provide rotational adjustment of strap assembly 70 as shown in FIG. 13. It can be appreciated that strap assembly 70 may be rotated along arrows C+ and C− as desired. It should also be noted that each mounting hole 80 has an associated radial array. As with bushing 24 and clamp 50, hand receiver 72 may be comprised of any suitable material, such as those described above with respect to bushing 24.

Figure 14C:
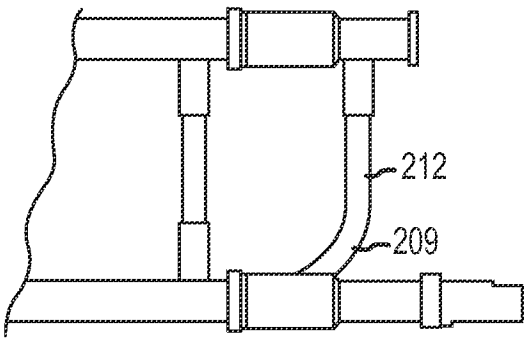
FIG. 14*c* is a schematic representation of a trombone first slide brace having a curved configuration.
Figure 14B:
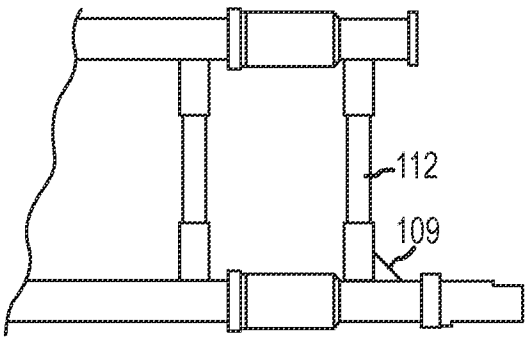
FIG. 14*b* is a schematic representation of a trombone first slide brace having a gusseted configuration.
Figure 14A:
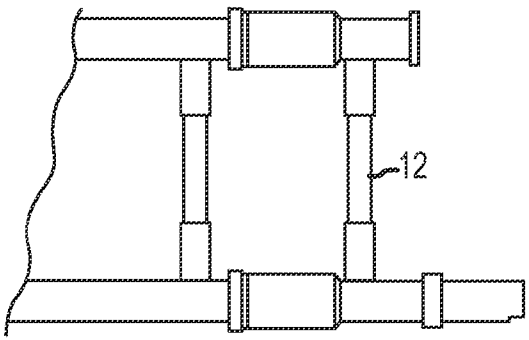
FIG. 14*a* is a schematic representation of a trombone first slide brace having a standard configuration.
Figures 15A, 15B, 15C:
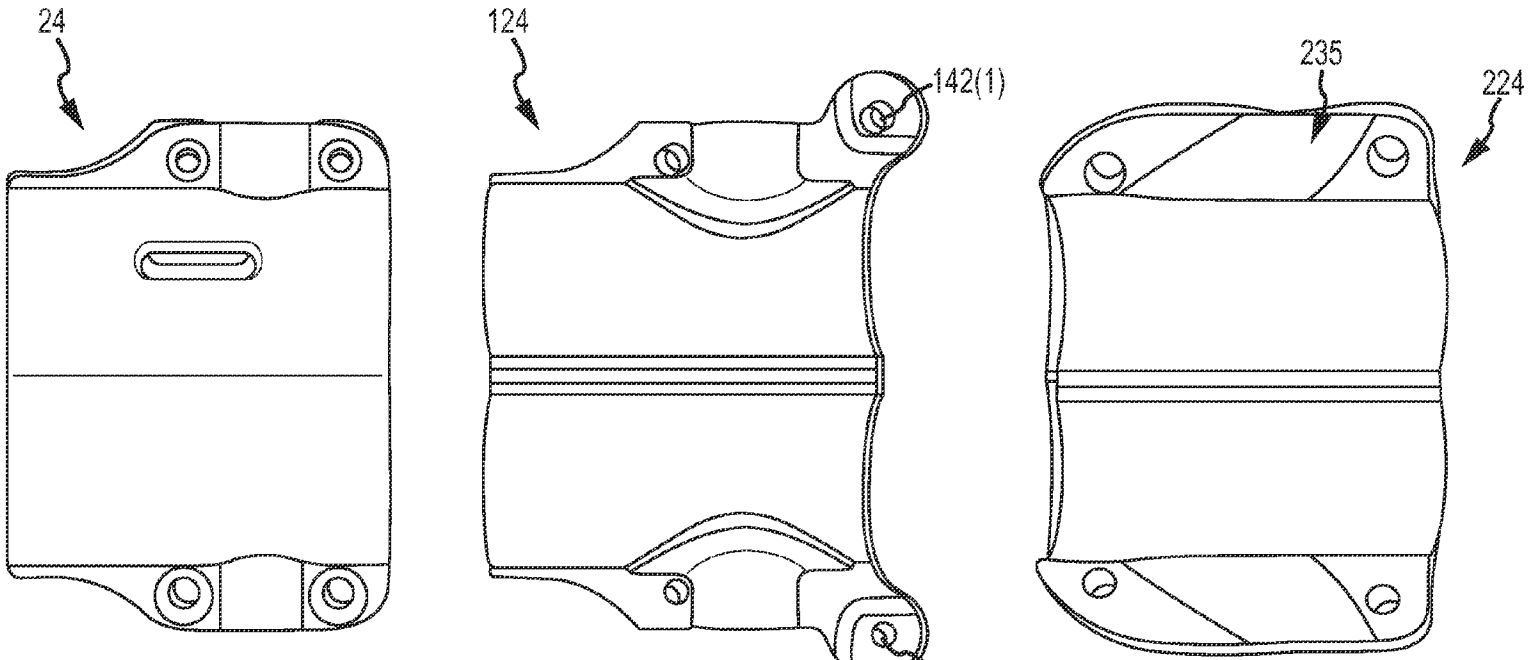
FIG. 15*a* is a top plan view of a hand grip device bushing for use on the standard first brace configuration shown in FIG. 14*a;*
FIG. 15*b* is a top plan view of a hand grip device bushing for use on the gusseted first brace configuration shown in FIG. 14*b;*
FIG. 15*c* is a top plan view of a hand grip device bushing for use on the curved first brace configuration shown in FIG. 14*c*.

FIGS. 14*a*, 14*b*, and 14*c* each illustrate various trombone first brace configurations. FIGS. 15*a*, 15*b*, and 15*c* show respective bushings that are suitable to attach to the various brace configurations shown in FIGS. 14*a*, 14*b*, and 14*c*. FIGS. 14*a* and 15*a* correspond with the standard first brace configuration 12 and matching bushing 24 as discussed above with respect to the exemplary embodiment. FIGS. 14*b* and 15*b* correspond with a first brace configuration 112 having a gusset 109. Bushing 124 is similar to bushing 24; however, mounting holes 142(1) and 142(2) are displaced to allow clearance for gusset 109. FIGS. 14*c* and 15*c* correspond with a first brace configuration 212 having a curved portion 209. Bushing 224 includes a corresponding curved first brace relief 235 as shown in FIG. 15*c*.

Figure 16:
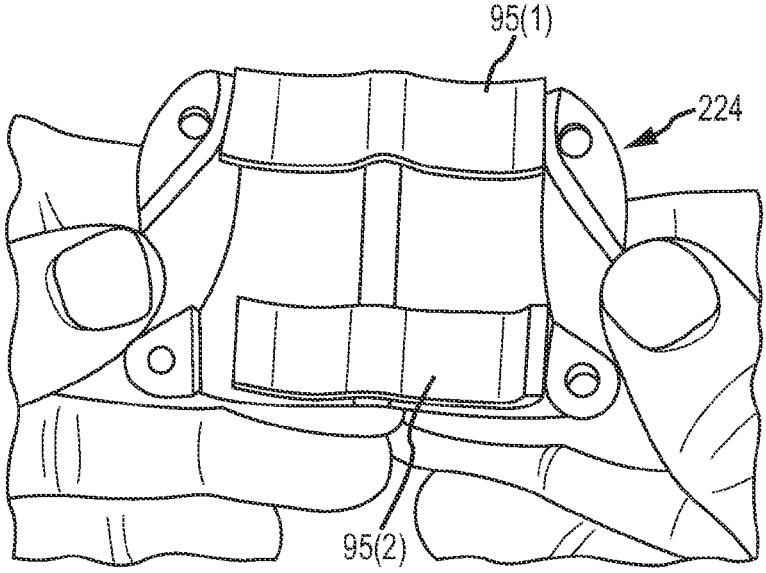
FIG. 16 is a top plan view of a hand grip device bushing illustrating the installation of shims.

In order to accommodate various sized slider tubes, the bushings may be provided with shims 95(1) and 95(2) as shown in FIG. 16. In this case, the shims are in the form of self-adhesive rubber strips. Multiple strips may be used to build up the desired shim thickness for various trombone tube sizes.

Having described the various components of the trombone hand grip device it should be appreciated that the components may be combined to form a trombone hand grip device kit. Such a kit could include a pre-assembled strap assembly 70, including clamp 50, hand receiver 72, and strap 74. Preferably, the kit would include a plurality of bushings (24, 124, and 224) for different configuration first braces as shown in FIGS. 15*a*, 15*b*, and 15*c*. Furthermore, the kit could include a plurality of shims 95 as shown and described with respect to FIG. 16.

Accordingly, the trombone hand grip device has been described with some degree of particularity directed to the exemplary embodiment. It should be appreciated, though, that the present invention is defined by the following claims construed in light of the prior art so that modifications or changes may be made to the exemplary embodiments without departing from the inventive concepts contained herein.

What is claimed is:

1. A trombone hand grip device, comprising:

A. a bushing securable about an intersection of a trombone's first brace and slide tube; and B. a hand grip removably attachable to said bushing, said hand grip adapted to receive the hand of a player, wherein said hand includes a clamp that is adapted for removable attachment to said bushing.

2. The trombone hand grip according to claim 1, wherein said bushing and said clamp include a cooperative slot and tab arrangement.

3. The trombone hand grip according to claim 1, wherein said hand grip includes a hand receiver fastened to said clamp.

4. The trombone hand grip device according to claim 3, wherein said hand grip includes a flexible strap attached to said hand receiver.

5. The trombone hand grip according to claim 3, wherein said hand receiver includes a plurality of mounting holes whereby the position of the hand grip may be adjusted longitudinally along the direction of the trombone slide.

6. The trombone hand grip according to claim 5, wherein said hand receiver includes at least one radial array of rotational adjustment holes associated with at least one of said mounting holes.

7. The trombone hand grip according to claim 6, wherein said clamp includes a protrusion sized and configured to engage said rotational adjustment holes.

8. A trombone hand grip device, comprising:

A. a bushing securable about a trombone's slide tube; and

B. a hand grip adapted to receive the hand of a player, said hand grip including:

i. a clamp removably attachable to said bushing;

ii. a hand receiver fastened to said clamp; and iii. a flexible strap connected to said hand receiver.

9. The trombone hand grip device according to claim 8, wherein said clamp is configured to snap onto said bushing.

10. The trombone hand grip device according to claim 9, wherein said bushing includes a tab and said clamp includes a mating slot, whereby said clamp pivots about said tab in order to snap onto said bushing.

11. The trombone hand grip device according to claim 8, wherein said bushing includes a clam shell configuration, said clam shell configuration adapted to close around an intersection of the slide tube and first brace of the trombone.

12. The trombone hand grip according to claim 8, wherein said hand receiver includes a plurality of mounting holes whereby the position of the hand grip may be adjusted longitudinally along the direction of the trombone slide, said hand receiver including a radial array of rotational adjustment holes associated with each said mounting hole, and wherein said clamp includes a protrusion sized and configured to engage said rotational adjustment holes.

13. A trombone hand grip kit, comprising:

A. a plurality of bushings securable about the intersection of a trombone's first brace and slide tube;

B. a hand grip removably attachable to said bushings.

14. The trombone hand grip kit according to claim 8, wherein each of said plurality of bushings is configured for a different first brace configuration.

15. The trombone hand grip kit according to claim 14 including a plurality of bushing shims.

16. The trombone hand grip kit according to claim 8, wherein said hand grip includes:

i. a clamp removably attachable to said bushing;

ii. a hand receiver fastened to said clamp through one of a plurality of mounting holes; and iii. a flexible strap connected to said hand receiver.

17. The trombone hand grip kit according to claim 16, wherein said hand grip is pre-assembled.

18. The trombone hand grip kit according to claim 16, wherein said hand receiver includes a radial array of rotational adjustment holes, and wherein said clamp includes a protrusion sized and configured to engage said rotational adjustment holes.

19. A trombone hand grip device, comprising:

A. a bushing securable about an intersection of a trombone's first brace and slide tube, wherein said bushing comprises two shells hingedly connected to each other; and B. a hand grip removably attachable to said bushing, said hand grip adapted to receive the hand of a player.

* * * * *